US005530972A

United States Patent [19]

Tanner

[11] Patent Number: 5,530,972

[45] Date of Patent: Jul. 2, 1996

[54] EMERGENCY EYEWASH FOUNTAIN

[75] Inventor: Stephen F. Tanner, Hockley, Tex.

[73] Assignee: Encon Safety Products, Houston, Tex.

[21] Appl. No.: 381,312

[22] Filed: Jan. 31, 1995

[51] Int. Cl.[6] ..... A61H 33/00

[52] U.S. Cl. ..... 4/620; 239/590

[58] Field of Search ..... 4/620; 239/543, 239/553, 590

[56] References Cited

U.S. PATENT DOCUMENTS

| | | | |
|---|---|---|---|
| 1,978,721 | 10/1934 | Perkins | 239/590 X |
| 3,106,722 | 10/1963 | Logan et al. | 4/145 |
| 3,413,660 | 12/1968 | Lagarelli et al. | 4/166 |
| 3,599,251 | 8/1971 | Wright | 4/166 |
| 3,792,814 | 2/1974 | Platz | 239/149 |
| 3,809,315 | 5/1974 | Wright | 239/31 |
| 4,012,798 | 3/1977 | Liautaud | 4/166 |
| 4,084,270 | 4/1978 | Kersten, Jr. | 4/145 |
| 4,363,146 | 12/1982 | Liautaud | 4/620 |
| 4,675,924 | 6/1987 | Allison et al. | 4/620 |
| 4,688,276 | 8/1987 | Allison et al. | 4/620 |
| 4,939,800 | 7/1990 | Fiorentino et al. | 4/620 |
| 5,157,798 | 10/1992 | Van Kammen | 4/620 |
| 5,216,765 | 6/1993 | Paterson et al. | 4/620 |
| 5,265,288 | 11/1993 | Alison | 4/620 |
| 5,293,833 | 3/1994 | West et al. | 116/276 |
| 5,381,567 | 1/1995 | Tanner et al. | 4/620 |

OTHER PUBLICATIONS

Advertisement by Guardian Equipment titled: *Quality Features and Options,* no publication date (believed to have been printed in mid–to–late 1970s), showing drawing of the dust cover described in the specification, p. 2, lines 25–28.

*Encon News Bulletin,* Encon Manufacturing Company, 4914 Dickson Street, Houston, Texas 77007.

*Primary Examiner*—Charles E. Phillips
*Attorney, Agent, or Firm*—John R. Kirk, Jr.; Jenkens & Gilchrist

[57] ABSTRACT

An eyewash fountain, particularly useful in industrial and laboratory environments, includes a pair of spray heads mounted on a distribution arm that is connected to a valve. The valve has a rotatable body that is connected to a base by a reversible retainer permitting the valve to be installed on either the left or right side of a sink or drain, and the distribution arm along with the spray heads swung or, alternatively, lowered to a position over the sink. The single action of moving the distribution arm over the sink is sufficient to initiate a flow of fluid to the eyes. Each of the spray heads has an internal volumetric flow regulator, a fluid pressure distributor or diffuser, and a large number of small apertures in the face of each head which direct a uniform, evenly distributed, low pressure flow of fluid to the eyes. Each of the spray heads also have an individual protective cover, mounted at a selectively variable position on each head, that is moveable away from its protective position in response to a flow of fluid from the apertures in the face of the spray head. The emergency eyewash fountain solves problems associated with ease of operation, fluid pressure and distribution control, protective enclosure of the spray heads during potentially long periods of nonuse, cleanability, serviceability, and adaptability to plural mounting positions.

9 Claims, 4 Drawing Sheets

EMERGENCY EYEWASH FOUNTAIN

TECHNICAL FIELD

This invention relates generally to a fountain for flushing contaminates from eyes, and more particularly to improvements in such a fountain that automatically initiates a flow of rinsing fluid through a pair of spray heads in response to moving the spray heads from a stored position to an operative position.

BACKGROUND ART

Eyewash fountains are typically used in industrial and laboratory environments to provide emergency flushing of human eyes after exposure to fumes, liquids or airborne debris that may be injurious to the eyes. Many of these devices require that an affected individual locate and rotate the spray heads over the sink or drain, then locate and turn on a valve to initiate a flow of rinsing water, and then modulate the valve to provide a stream of water at a desirable pressure and in an appropriate volume. This may be difficult, or even impossible to carry out if the individual's sight is impaired. In response to this problem, spray heads that swivel laterally, or lower vertically, from a stored position to a operative position and automatically initiate a flow of rinsing fluid when in the operative position have been proposed. However, heretofore, such moveable spray heads have either been freely rotatable about a 360° arc, or moveable through a limited are in an nonmodifiable single direction. That is, the spray heads could move from a stored position through a limited are in a counterclockwise direction to an operative position, or alternatively in a clockwise direction from stored to operative positions, but could not be selectively altered to do both. That meant, that separate constructions were required when mounting the spray heads on the left side and right side of a sink or basin.

In order to provide an adequate volume of water at a relatively low pressure, various "soft-spray" heads have been proposed. One practice is to place a foam material inside of a spray head to soften the flow and trap debris, as shown U.S. Pat. No. 4,363,146, issued Dec. 14, 1982 to John R. Liautaud. Other proposed solutions to this problem include aerating the water emitted through the spray head or using loose balls in a flow chamber to agitate and modify the water flow prior to exit through the tip of the nozzle. Also, U.S. Pat. No. 3,809,315, issued May 7, 1974 to Allen C. Wright discloses a nozzle structure for a eyewash spray head that has a conical chamber integrally formed within the nozzle, and four circular ports which direct water from the conical chamber to a single enlarged opening through which water is discharged directly to the eyes.

Emergency eyewash fountains, by the very nature of their intended use, often may go for several months, or longer, without use. This infrequent use permits rust, corrosion, bacteria and other undesirable materials to accumulate in the spray heads and supply lines. It is therefore desirable that the interior of the spray heads be easily cleanable. The above described proposed solutions to providing a soft spray generally are difficult to clean and service. For example, the foam products may trap bacteria and can deteriorate, causing small pieces of the foam debris-laden to be carried by the rinse fluid into the eyes being treated. The integrally formed conical chamber in the nozzle structure proposed by Wright is not only difficult to clean, but since it discharges the wash stream through a single large opening, debris in the nozzle and supply lines can be readily injected directly into the eyes.

It has also been proposed that covers be placed over the heads of the spray nozzles to prevent dust and other airborne debris from settling in the nozzle during periods of nonuse. For example, Guardian Industries produces a wash fountain having a positionally fixed, water-activated, flat plate cover over each nozzle that protects the nozzle from failing debris but does not provide a seal against the intrusion of blowing dust or other airborne debris.

The present invention is directed to overcoming the problems set forth above. It is desirable that an emergency eyewash fountain be readily useable, i.e., it does not require the reading of detailed operating instructions, or turning and manually modulating flow control valves, to initiate a flow of rinse water. It is also desirable to have an emergency eyewash fountain system wherein the spray system is selectively mountable on either the right or left side of a sink, and the spray heads moveable through a limited arc to a position over the sink. Furthermore, is desirable to have an emergency eyewash fountain that provides a soft, clean, and generous spray of rinse fluid at a uniform pre controlled rate. Also, it is desirable to have an emergency eyewash fountain that is easy to service, clean and maintain over potentially long periods of nonuse and has a separately removable protective cover that automatically opens in response to a flow of water from spray head.

DISCLOSURE OF THE INVENTION

In accordance with one aspect of the present invention, an eyewash fountain comprises a valve and a pair of spray heads that are in mutual fluid communication with a distribution conduit. The valve has a base with an internal passageway in fluid communication with a source of pressurized fluid and a recess extending inwardly from an exterior wall. The recess has a pair of abutment surfaces defined therein. The valve also has a body member rotatably mounted on the base and has an interior passageway in fluid communication with the distribution conduit. A reversible retainer member is removably attached to the body portion and extends into the recess in the base. The retainer member also has a pair edge surfaces that are respectively abutable with one of the abutment surfaces in the recess in response to rotating the body member between a first position at which the internal passageways in the base and body portion are nonaligned, and a second position at which the respective internal passageways are aligned and in fluid communication with each other.

Other features of the eyewash fountain include the retainer member being essentially a flat plate having first and second sides, and the body member being rotatable through a first predefined arc when the retainer member is attached to the body member with the first side in abutment with the body member, and through a different second predefined are when the retainer member is attached to the body member with the second side in abutment with the body member.

In another aspect of the present, an eyewash fountain has a valve disposed between a source of pressurized fluid and a distribution conduit, and a pair of spray heads having a mounting base with an internal passageway in fluid communication with the distribution conduit. The mounting base has a radial surface internally disposed within the base in concentric relationship with the internal passageway in the base. Each of the spray heads also have a flow directing cap that has a face portion with a plurality of apertures extending therethrough, and a removable fluid flow diffuser disposed between the mounting base and the face portion of the cap. The diffuser is in the shape of a truncated cone with the base of the cone spaced from the radial surface in the mounting base and the truncated surface of the cone in abutting contact with the face portion of the cap. Each of the spray heads also has a cover that is rotatably mounted on the cap and is moveable from a first position at which the cover encloses the face portion of the cap to a second position at which the cover is spaced from the face portion in response to a flow of fluid through the apertures in the face portion.

Other features of the eyewash fountain embodying the present invention include the conical base of the diffuser disposed in each of the spray heads being maintained at a predetermined distance from the radial surface in the mounting base by a plurality of tabs disposed about the periphery of the conical base of the diffuser, and the periphery of the conical base and the radial surface defining a circumferential opening in which the tabs occlude less than 25% of the opening.

BEST MODE FOR CARRYING OUT THE INVENTION

Figure 1:
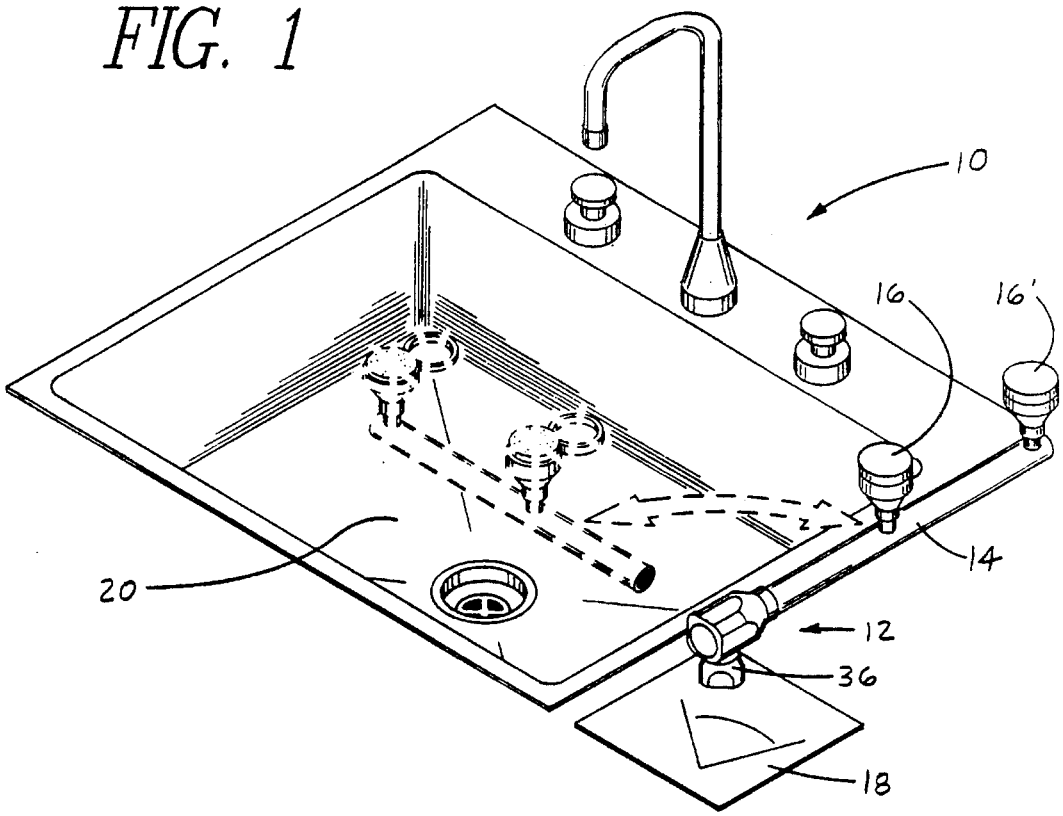
FIG. 1 is a perspective view of the eyewash fountain embodying the present invention in which the spray heads are mounted for storage during nonuse at a position to the right of a sink, and are rotatable to an operative position over the sink.
Figure 2:
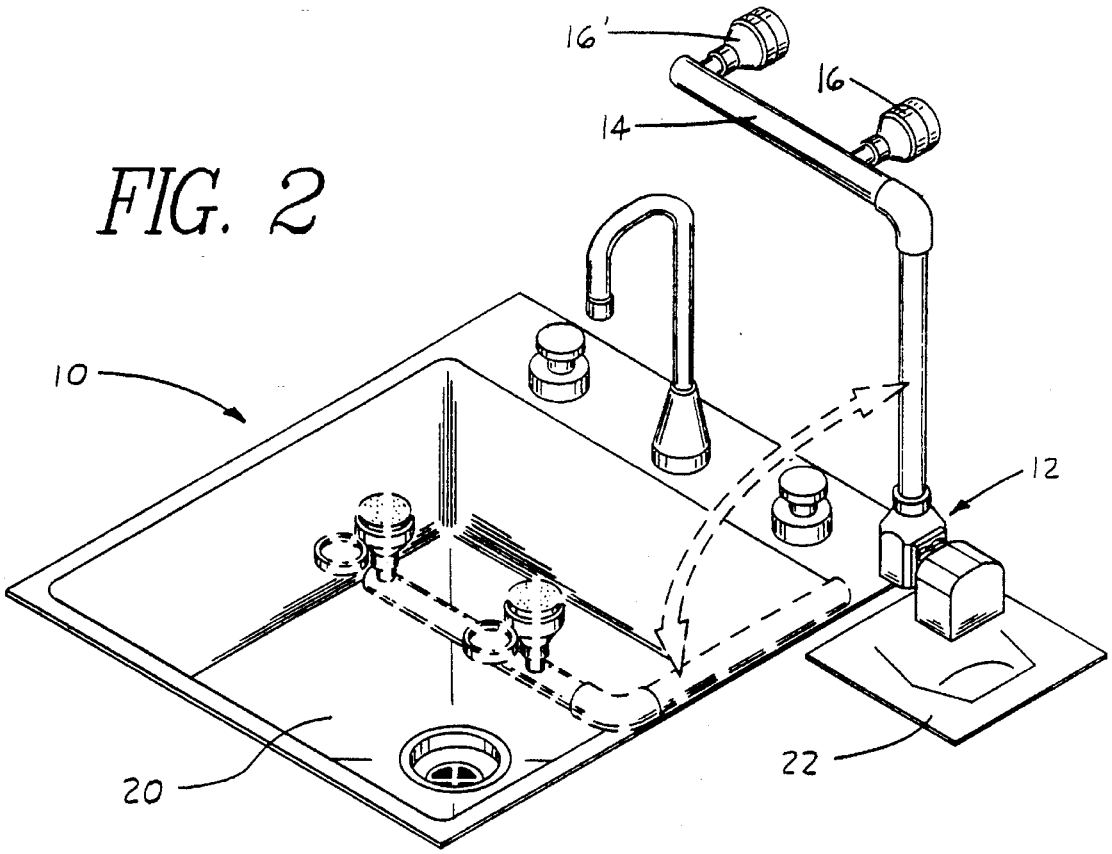
FIG. 2 is a perspective view of the eyewash fountain embodying the present invention in which the spray heads are mounted for storage during nonuse in a vertical position over a sink, and are lowered to an operative position over the sink.

An emergency eyewash fountain assembly 10 embodying the present invention includes a swivel valve 12, a distribution conduit 14 removably mounted to the valve 12, and a pair of spray heads 16,16' removably mounted on the distribution conduit 14. Importantly, the eyewash fountain assembly 10 may be selectively mounted on a horizontal surface 18 at the side of a sink 20 as shown in FIG. 1, or on a similar horizontal surface 22 at the rear of the sink 20 as shown in FIG. 2. Alternatively, the eyewash fountain assembly 10 may be mounted on a vertical surface above and at the rear or at either side of the sink 20. As described below in more detail, the swivel valve 12 has a reversible retainer member 24 that permits the eyewash fountain 10 to be mounted on either a vertical or horizontal surface to the left or right side of the sink 20.

Figure 5:
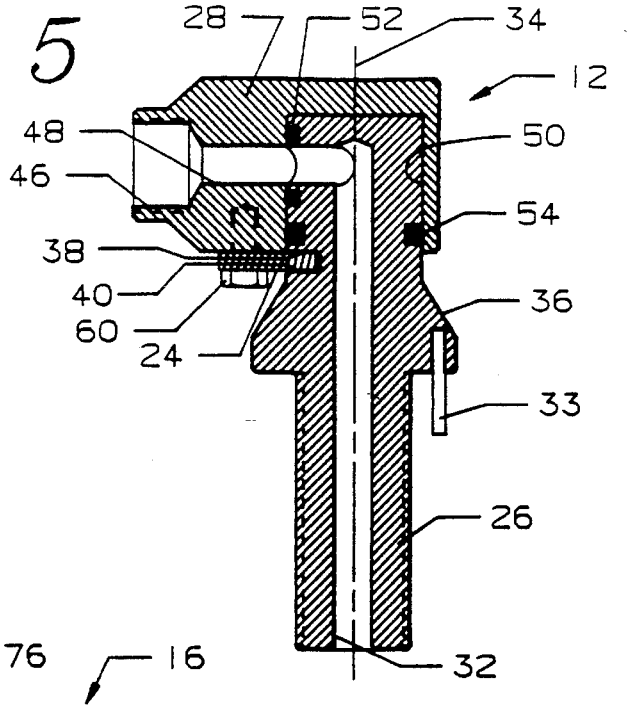
FIG. 5 is a longitudinal sectional view of the valve component of the eyewash fountain embodying the present invention.

As best shown in FIG. 5, the swivel valve 12 has three primary components; a base 26, a body member 28, and the retainer member 24 which maintains the body member 28 is a directionally selective, rotatable position on the base 26. The base 26 is demountably attached to a selected fixed surface, such as the horizontal surface 18, by a threaded nut 30 that engages external threads on the base 26. A washer 31 is desirably positioned between the nut 30 and the mounting surface 18, and the base 26 is maintained in a desired fixed angular orientation with respect to the sink 20 by a spring biased vandal pin 33, that extends through an opening provided in the mounting surface 18. The valve base 26 is also connected to a source of pressurized fluid, not shown, such as a water system or a fluid maintained in an elevated or pressurized tank. The valve base 26 has an internal passageway 32 that is concentrically disposed about a longitudinal axis 34 normal to the mounting surface 18, and is in fluid communication with the source of pressurized fluid.

The valve 12 also has an exterior wall surface 36 that is generally radially spaced from the longitudinal axis 34, and a pair of spaced apart radial wall surfaces 38,40 that extend inwardly from the exterior wall surface 36 to a pair of abutment surfaces 42,44 that are normal to the radial wall surfaces 38,40. The radial wall surfaces 38,40 and the abutment surfaces 42,44 cooperate to define a recess in the valve base 26 that, upon assembly, receives the retainer 24.

The body member 28 of the valve 12 has a threaded port 46 that receives the distribution conduit or arm 14, an internal passageway 48 extending inwardly from the threaded port 46 to an internal cylindrical wall surface 50. The internal cylindrical wall 50 mates with a cylindrical portion of the exterior wall surface 36 of the base 26 such that the body member 28 is rotatable, with respect to the base 26, about the longitudinal axis 34. Thus, when the base 26 is mounted on a horizontal surface 18, as shown in FIG. 1, the longitudinal axis 34 extends in a vertical direction, and the body member 28 is rotatable about the vertically oriented longitudinal axis 34. The distribution arm 14, having the spray heads 16,16' mounted thereon, being connected to the body member 28, is therefore moveable through a horizontal are having limits and location determined by the orientation of the retainer member 24, as discussed below. Likewise, when the valve base 26 is mounted on a vertical surface 22, as shown in FIG. 2, the body member 28 is rotatable about the then horizontally disposed longitudinal axis 34, and the distribution arm 14 and spray heads 16,16' mounted thereon are moveable through a vertical arc from a stored position to an operating position over the sink 20.

Figure 3:
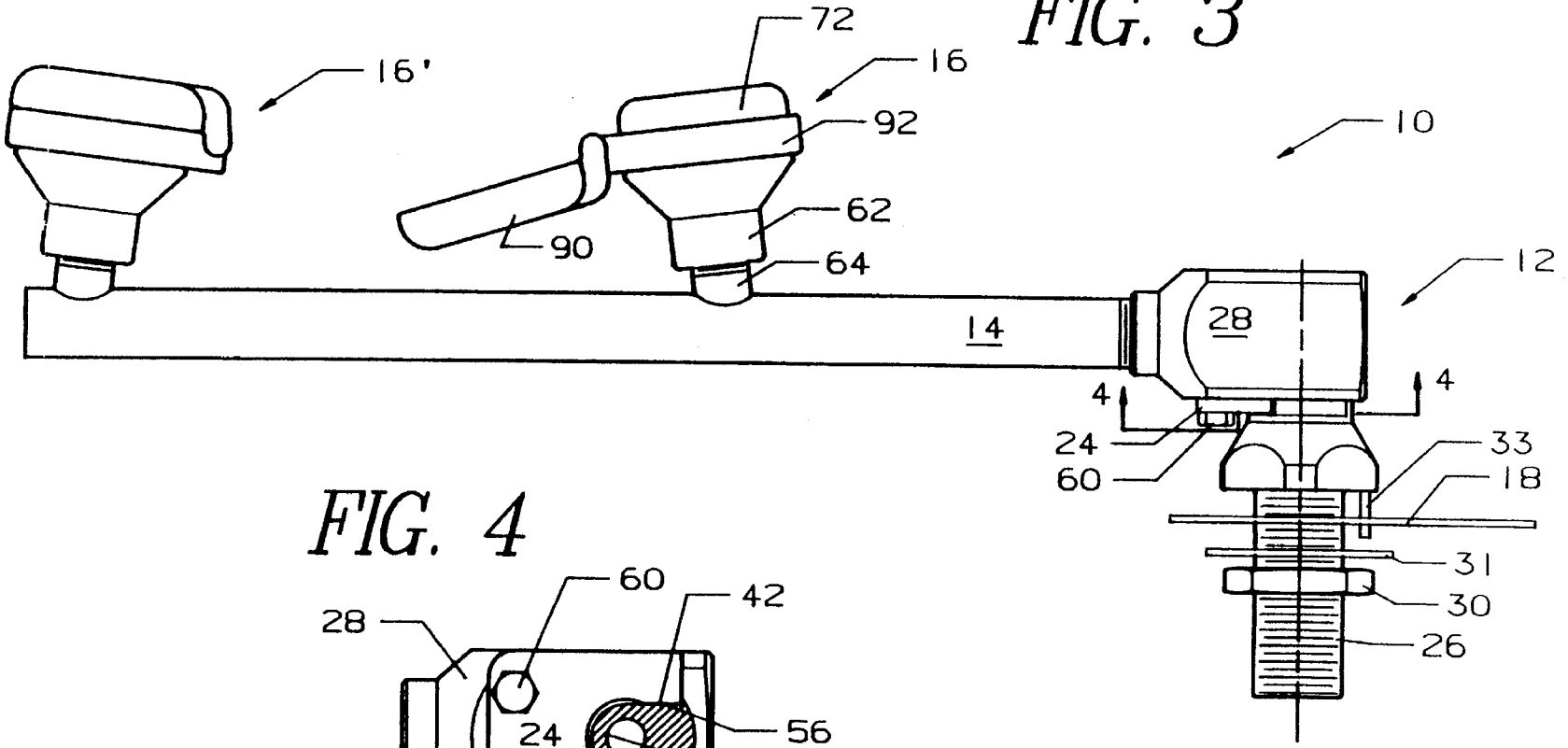
FIG. 3 is an elevational view of the eyewash fountain assembly shown in FIG. 1.

The internal passageway 32 in the valve base 26 has a lateral branch at its upper end such that when the body member 28 is rotated from a stored to an "on" or operative position, the respective internal passageways 32,48 are aligned, as shown in FIG. 3, in fluid communication with each other. In the stored, or "off" position, the body member 28 is rotated so that the internal passageway 48 in the body member 26 is not aligned with the internal passageway 32 in the base 26 and, accordingly, there is no fluid communication between the passageways 32,48. When in the operative position, the spray heads 16,16', by way of the distribution conduit 14 and the swivel valve 12, are in fluid communication with a source of pressurized fluid. A pair of O-ring seals 52,54 are disposed in annular grooves in the cylindrical exterior wall surface 36 of the valve base 26 to prevent fluid leakage between the moveable body member 28 and stationary base 26.

Figure 4:
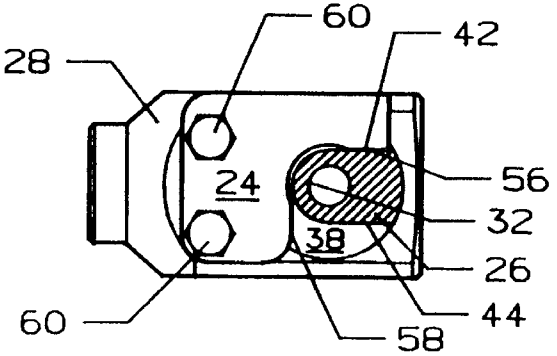
FIG. 4 is a bottom view of the body member of the valve component embodying the present invention, taken along the line 4—4 of FIG. 3, with a protuberant portion of the base of the valve shown in section.

The retainer member 24 is preferably a flat plate having first and second sides, and two predefined edge surfaces 56,58 that are respectively abutable with a selected one of the abutment surfaces 42,44 in the recess of the valve base 26. The retainer 24 is remountably attached to the body member 28 by a pair of cap screws 60 that engage threads provided in the body member 28. The valve 12, as shown in FIGS. 3, 4 and 5, is in an "on" or operative position, i.e., the respective internal passageways 32,48 in the base 26 and body member 28 are aligned. When the retainer 24 is mounted on the body member 28 as shown in FIG. 4, the predefined edge surface 56 of the retainer 24 abuts the abutment surface 42 in the recess of the valve base 26, and not only determines the limit of rotation of the body member 28 in a clockwise direction as viewed in FIG. 4, but also assures alignment of the internal passageways 32,48. To turn the flow of fluid off, the distribution arm 14 is moved to rotate the body member 28 in a counter-clockwise direction, as viewed in FIG. 4, through a 90° angular arc, or sector, at which limit the second predefined edge surface 58 of the retainer 24 abuts the second abutment surface 44 in the recess of the base 26. As viewed from above the horizontal surface 18, as in FIG. 1, the distribution arm 14 is rotated in a counter-clockwise direction to turn the fountain 10 on and initiate a flow of fluid from the spray nozzles 16,16'. After flushing the eyes, the distribution arm 14 is swung 90° in a clockwise direction to move the spray heads 16,16' to the stored position at the side of the sink 20, whereby body member 28 of the valve 12 is rotated so that the internal passageways 32,48 are no longer aligned and the flow of fluid to the spray heads 16,16' is terminated.

If it is desired to mount the eyewash fountain 10 to the left of a sink, the spray heads 16,16' may be moved clockwise through a 90° circular sector from the stored to operative position by simply flipping, or reversing, the retainer member 24. With the opposite side, i.e., the lower side as viewed in FIG. 5, of the retainer 24 in abutment with the body member 28, the body member can be turned through a 90° circular sector that is opposite in direction to first described operation. That is, the distribution arm 14 may then be swung clockwise 90° to move the spray heads 16,16' from the stored position at the left-hand side of the sink, to the operative "on" position over the sink, and counter-clockwise after use to terminate the fluid flow and move the heads 16,16' back to the stored position. It can be seen that this same directionally selective movement arrangement is equally applicable to a vertically mounted fountain 10 in which different directions of operation are also required, depending on which side of the sink or drain centerline that the base 26 is mounted.

Figure 6:
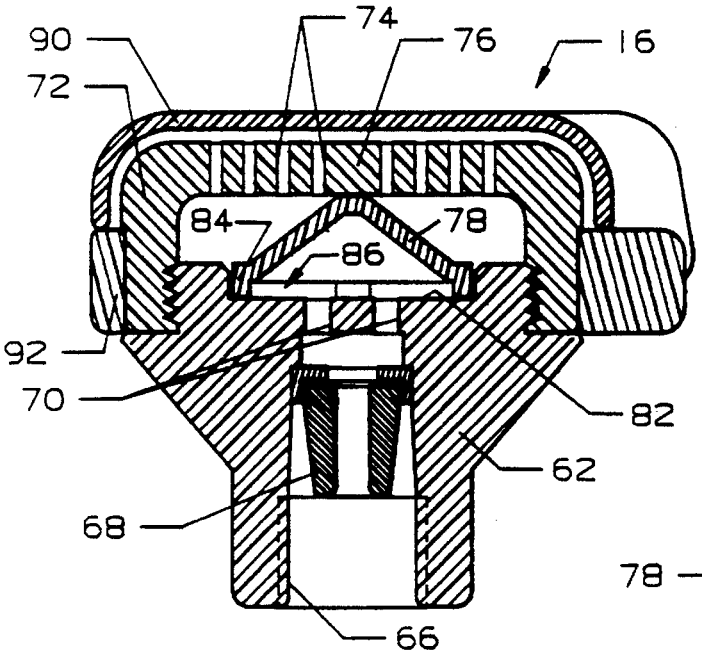
FIG. 6 is a longitudinal sectional view of one of the spray heads of the eyewash fountain embodying the present invention.
Figure 7:
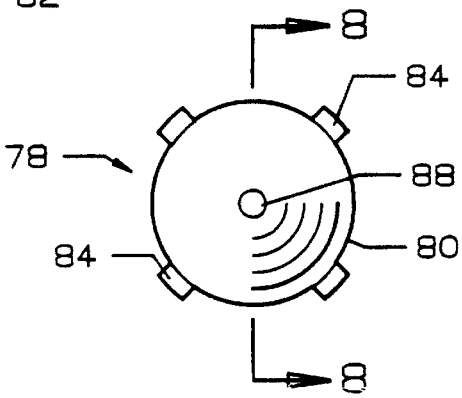
FIG. 7 is a top view of a diffuser disposed within each of the spray heads of the eyewash fountain embodying the present invention.
Figure 8:
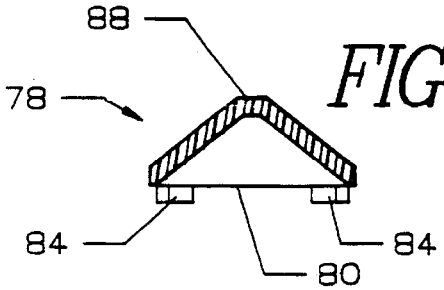
FIG. 8 is a cross-sectional view of the diffuser, taken along the line 8—8 of FIG. 7.

The eyewash fountain assembly 10 embodying the present invention also has a pair of spray head assemblies, designated in FIGS. 1, 2 and 3 by the reference numerals 16,16'. Both of the spray head assemblies 16,16' are identical and, for the sake of clarity, the following discussion will be with reference to a single spray head, with the understanding that the construction and features described are applicable to both. As shown in FIG. 6, the spray head 16 has a mounting base 62 that is demountably attached to the distribution arm or conduit 14 by internal threads that engage the external threads of a T-connector 64 on the distribution conduit 14. The mounting base 62 has an internal passageway 66 that is in fluid communication with the distribution conduit 14 and has a volumetric fluid flow regulator 68 disposed within the internal passageway 66. In the preferred embodiment of the present invention, the flow regulator 68 is selected to assure a fluid flow rate of approximately 1.2 gallons per minute at a supply pressure of from 30 to 60 psi. Four flow distribution apertures 70 are provided at the upper end of the internal passageway 62, and have a combined cross-sectional area significantly greater than that of the regulator 68.

The spray head 16 also has a flow directing cap 72 that is removably attached to the mounting base 62 by mating threads on the an interior surface of the cap 72 and the exterior surface of the mounting base 62. The cap 72 has a plurality of small apertures 74 extending through a broad face portion 76 of the cap 72. In the preferred embodiment, the face portion 76 has 50 holes 74, each with a diameter of 0.046 inch arranged in four concentric rings, radially spaced at 0.125 inch increments, with the outer ring having a diameter of 1.0 inch. The large plurality of small openings 74 block potential debris that may be in the fountain or supply passages, and provide a uniform spray of small droplets that have a beneficial flushing action of the eyes without the localized high pressure areas in the spray common with large port nozzle arrangements.

Importantly, to further assure an even pressure distribution across the fluid stream exiting the apertures 74, the spray head 16 also has a removable fluid flow diffuser 78 positioned between the flow regulator 68 in the mounting base 62 and the face portion 76 of the cap 72. The diffuser 78 has the shape of a truncated cone, with the base 80 of the cone spaced from a flat, radially extending surface 82 in the mounting base 62. As shown in FIG. 6, the radial surface 82 is concentrically disposed with respect to the internal passageway 66 in the mounting base 62, and the base 80 of the diffuser 78 is spaced from the radial surface 82 by a plurality of tabs 84 positioned adjacent, but exterior to, the periphery of the conical base 80. In the preferred embodiment of the present invention, the diameter of the conical base 80 of the diffuser 78 has a diameter of 0.74 inch and accordingly, a circumference of 2.325 inches. Four tabs 84, each having a height of 0.06 inch and a width of 0.12 inches, support the conical base 80 in the spaced position above the radial surface 82. Thus, it can be seen that the conical base 80 and the radial surface 82 define a circumferential opening 86 through which fluid is evenly distributed about the periphery of the cap 72, with the small tabs 84 occluding, or blocking, only about 20% of the opening 86. Preferably, to assure even distribution of fluid from the flow regulator to the apertures 74 in the face 76 of the cap 72, at least 75% of the circumferential area around the base 80 of the diffuser 78 should be open to flow, i.e., there should be less than 25% blockage of the opening 86. It is important that the total open area of the circumferential opening 86 be greater than the combined area of the distribution apertures 70 and also greater than the total cross-sectional area of the apertures 74 in the cap 72 to assure a sufficient, uniformly distributed flow of pressurized fluid is delivered at a controlled rate to the apertures 74. The truncated upper surface 88 of the conical diffuser 78, upon assembly of the cap 72 on the mounting base 62, abuts the underside of the face portion 76. Preferably, all of the spray head components, with the possible exception of the flow regulator 68 are formed of a moldable, rigid plastic material such as Acetal™, which may be colored for high visibility.

Thus, from the foregoing discussion it can be seen that upon swinging the distribution arm 14 to the operating position, the internal passageways in the valve 12 are automatically aligned, and a flow of fluid will be directed through the distribution arm 14 to the internal passageway 66 in the mounting base 62 of the spray head 16. The flow rate of the fluid is then regulated by flow regulator 68, diffused to provide a uniform pressure distribution of the fluid stream by passage of the stream through the circumferential opening 86 at the base of the diffuser 78, and then directed through the apertures 74 in the cap 72 as a large number of streams of finely divided droplets to the eyes of the user in need. Also, it can be seen that the entire spray head 16 is easily disassemblable for cleaning or service.

The spray head 16 also desirably has a protective cover 90 that is pivotably mounted on a ring 92 that is rotatably mounted on the periphery of the cap 72. The ring 92 can be rotated so that the cover 90 is in a desired orientation with respect to the spray head 16. It is desirable to rotate the ring 92 so that the cover 90 will open in the direction toward which the spray head 16 is inclined. For example, on the leftwardly tilted spray head 16 in FIG. 3, the pivot hinge of the cover 90 is positioned on the left side of the head, whereas on the rightwardly angled spray head 16' the ring is rotated so that the pivot hinge is on the right side of the head 16'. Importantly, regardless of the direction of opening, the cover 90 is instantaneously flipped away from it's normal 72. closed position in response to a flow of water through the apertures 74 in the cap Industrial Applicability The eyewash fountain 10 embodying the present invention is particularly useful in industrial and laboratory environments for flushing contaminants from human eyes. The eyewash fountain 10 has a moveable arm 14 on which a pair of spray heads 16,16' each have an internal volumetric flow regulator 68 and a flow distributor, or diffuser 78, and are oriented in an angled direction so that a soft, but high volume, stream comprising uniformly distributed fine droplets of fluid, such as water, are delivered at a uniform pressure and rate simultaneously to each eye. Moreover, the spray heads 16,16' of the eyewash fountain 10 are easily disassembled for cleaning after a long period of nonuse, or for service or repair. Also, each of the spray heads 16,16' have a protective cover over the apertured flow directing face portion 76 that can be selectively mounted at a desired radial position around the cap 72, and is automatically moved from its protective enclosure position in response to a flow of fluid from the face portion 76.

The eyewash fountain 10 embodying the present invention is instantly useable upon demand by simply swinging, or pulling, the distribution arm 14 containing the spray heads 16,16' to an operating position over a sink or drain 20. This single, simple and natural action, immediately places the spray heads 16,16' in direct communication with a source of pressurized fluid, and the above described beneficial spray of fluid is delivered to the eyes of the user in need. No adjustable valves need to be turned on, no flow rate adjustments need to be made, and no lengthy instructions need to be read and understood in order for one to operate the eyewash fountain 10, and therefore is especially advantageous in emergency situations.

A reversible retainer 24 in the swivel valve 12 enables the eyewash fountain 10 embodying the present invention to be mounted in virtually any normal position. The eyewash fountain 10 can be mounted on a horizontal or vertical surface, to either the left or right side of a sink, drain or basin. This important advantage obviates the need for different models, constructions, or adapters to accommodate a multitude of possible mounting positions, and therefore provides important economic advantages to both the manufacturer and installer, in addition to the above described operational benefits.

Other aspects, features and advantages of the present invention can be obtained from a study of this disclosure together with the appended claims.

What is claimed is:

1. An eyewash fountain, comprising:

a valve having a base in fluid communication with a source of pressurized fluid, a body member in fluid communication with a distribution conduit, and a retainer member, said base having a longitudinal axis and an exterior wall surface generally radially spaced from said longitudinal axis, a pair of spaced apart parallel walls extending inwardly from the exterior wall surface, and a pair of abutment surfaces normal to said parallel walls, said parallel walls and abutment surfaces cooperating to define a recess in said base, and a retainer member removably attached to said body member in a selectively reversible position, said retainer member extending into the recess in said base and having a two predefined edge surfaces that are respectively abutable with a preselected one of said abutment surfaces of the recess in said base in response to rotating said body member about the longitudinal axis of said base; and a pair of spray heads in fluid communication with said distribution conduit.

2. The eyewash fountain, as set forth in claim 1, wherein said retainer member is essentially a flat plate having first and second sides, and said body member is rotatable through a first circular sector when the retainer member is attached to the body member with said first side in abutment with the body member and through a second circular sector when the retainer member is attached to the body member with said second side in abutment with the body member, said first circular sector being disposed in a clockwise direction of rotation of said body member from a stored to an operative position, and said second circular sector being disposed in a counter-clockwise direction of rotation of said body member from said stored to said operative position.

3. An eyewash fountain, comprising:

a valve interposed a source of pressurized fluid and a distribution conduit; and a pair of spray head assemblies, each having a mounting base with an internal passageway in fluid communication with said distribution conduit, a volumetric fluid flow regulator disposed in the internal passageway, a radial surface and a circumferential wall both being concentrically disposed about said internal passageway and cooperating to define a stepped shoulder in said mounting base, a flow directing cap removably attached to said mounting base and having a face portion with a plurality of apertures extending therethrough, a removable fluid flow diffuser disposed between said mounting base and the face portion of said cap, said diffuser having the shape of a truncated cone with the base of the cone spaced from the radial surface in said mounting base and the truncated surface of the cone in abutting contact with the face portion, and a protective cover closeable over said face portion.

4. The eyewash fountain, as set forth in claim 3, wherein the conical base of said removable fluid flow diffuser is maintained at a predetermined distance from the radial surface in said mounting base by a plurality of tabs disposed about the periphery of the conical base, said periphery of the conical base of the diffuser and said radial surface in the mounting base defining a circumferential opening and said tabs occlude less than 25% of said circumferential opening.

5. The eyewash fountain, as set forth in claim 3, wherein said protective cover is rotatably mounted on said cap at a selectively variable radial position, and is pivotably moveable from a first position at which said cover encloses said face portion of the cap, and a second position at which said cover is spaced from the face portion in response to a flow of fluid through the apertures in said face portion.

6. An eyewash fountain, comprising:

a valve interposed a source of pressurized fluid and a distribution conduit, said valve consisting essentially of a base having an internal passageway in fluid communication with said source of pressurized fluid, an exterior wall surface, a pair of spaced apart parallel walls extending inwardly from the exterior wall surface and a pair of abutment surfaces normal to said parallel walls, said parallel walls and abutment surfaces cooperating to define a recess in said base, a body member rotatably mounted on said base and having an internal passageway in fluid communication with said distribution conduit, and a retainer member removably attached to said body member in a selectively reversible position, said retainer member extending into the recess in said base and having two predefined edge surfaces that are respectively abutable with one of said abutment surfaces disposed in the recess in said base in response to rotating said body member between a first position at which the internal passageways of the base and body member are in nonaligned relationship, and a second position at which the internal passageways of the body member and base are aligned and in fluid communication with each other: and a pair of spray head assemblies, each having a mounting base with an internal passageway in fluid communication with said distribution conduit and a volumetric fluid flow regulator disposed in the internal passageway, a flow directing cap removably attached to said mounting base and having a face portion with a plurality of apertures extending therethrough, a removable fluid flow diffuser disposed between said mounting base and the face portion of said cap, said diffuser having the shape of a truncated cone with the base of the cone spaced from the mounting base and the truncated surface of the cone in abutting contact with the face portion of said cap, and a cover rotatably mounted at a selectively variable radial position on said cap and pivotably moveable from a first position at which said cover protectively encloses said face portion and a second position at which said cover is spaced from the face portion in response to a flow of fluid through the apertures in said face portion.

7. The eyewash fountain, as set forth in claim 6, wherein the base of said valve is mounted on a horizontal surface and the body member of said valve is rotatable about a vertical axis, whereby said distribution conduit and the pair of spray heads are moveable through a horizontal arc having a limit of motion determined by the respective abutment one of said predefined edge surfaces of the retainer member with a corresponding abutment surface of the recess in said base.

8. The eyewash fountain, as set forth in claim 6, wherein the base of said valve is mounted on a horizontal surface and the body member of said valve is rotatable about a horizontal axis, whereby said distribution conduit and the pair of spray heads are moveable through a vertical arc having a limit of motion determined by the respective abutment one of said predefined edge surfaces of the retainer member with a corresponding abutment surface of the recess in said base.

9. The eyewash fountain, as set forth in claim 6, wherein the base of said valve is mounted on a vertical surface and the body member of said valve is rotatable about a horizontal axis, whereby said distribution conduit and the pair of spray heads are moveable through a vertical arc having a limit of motion determined by the respective abutment of one of said predefined edge surfaces of the retainer member with a corresponding abutment surface of the recess in said base.

* * * * *